US006530116B2

(12) United States Patent
Berfield et al.

(10) Patent No.: US 6,530,116 B2
(45) Date of Patent: Mar. 11, 2003

(54) VACUUM CLEANER WITH MUFFLED DETACHABLE BLOWER EXHAUST

(75) Inventors: Robert C. Berfield, Jersey Shore, PA (US); Ronald Griffin, Williamsport, PA (US); Craig Seasholtz, Avis, PA (US)

(73) Assignee: Shop Vac Corporation, Williamsport, PA (US)

( * ) Notice: Subject to any disclaimer, the term of this patent is extended or adjusted under 35 U.S.C. 154(b) by 0 days.

(21) Appl. No.: 09/782,496

(22) Filed: Feb. 13, 2001

(65) Prior Publication Data

US 2002/0108205 A1 Aug. 15, 2002

(51) Int. Cl.[7] ..... A47L 5/14

(52) U.S. Cl. ..... 15/328; 15/327.6; 15/326; 15/412

(58) Field of Search ..... 15/328, 327.6, 15/353, 326, 412

(56) References Cited

U.S. PATENT DOCUMENTS

| | | | | |
|---|---|---|---|---|
| 2,276,844 A | | 3/1942 | Holm-Hansen | 15/330 |
| 2,335,031 A | | 11/1943 | Stevens | 15/327.2 |
| 2,884,185 A | * | 4/1959 | Dolan | 15/326 |
| 3,732,667 A | | 5/1973 | Fromknecht et al. | 15/323 |
| 3,909,219 A | * | 9/1975 | Fromknecht | 55/378 |
| 4,120,616 A | | 10/1978 | Dwyer et al. | 15/326 |
| 4,330,899 A | | 5/1982 | Miller et al. | 15/326 |
| 4,512,713 A | | 4/1985 | Berfield | 15/326 |
| 4,538,971 A | | 9/1985 | Miller et al. | 15/413 |
| 4,735,555 A | | 4/1988 | Erickson, Jr. | 417/244 |
| 4,797,072 A | | 1/1989 | Berfield et al. | 15/326 |
| 4,836,753 A | | 6/1989 | Berfield et al. | 417/236 |
| 4,845,793 A | | 7/1989 | Meyer | 15/328 |
| 4,880,364 A | | 11/1989 | Berfield et al. | 417/423.1 |
| 5,005,251 A | | 4/1991 | McLeod et al. | 15/328 |
| 5,159,738 A | * | 11/1992 | Sunagawa et al. | 15/326 |
| 5,183,982 A | | 2/1993 | Smith et al. | 200/61.85 |
| 5,353,470 A | | 10/1994 | Bartlett | 15/328 |
| 5,365,633 A | | 11/1994 | Sunagawa et al. | 15/326 |
| 5,388,301 A | | 2/1995 | Bosyj et al. | 15/327.1 |
| 5,404,614 A | | 4/1995 | Stephens | 15/327.2 |

(List continued on next page.)

FOREIGN PATENT DOCUMENTS

CA 461861 12/1949

OTHER PUBLICATIONS

Owner's Manual, Hoover Wet/Dry Vac with Portable Blower and Exclusive two tank system (on information and belief 1993).

Color photographs, Hoover Wet/Dry Vac with Portiable Blower (on information and belief 1993).

Brochure, Genie Wet/Dry Vac (on information and belief 1993).

Photographs (4) of vacuum cleaner wooden model (Apr. 1999).

*Primary Examiner*—Theresa T. Snider

(57) ABSTRACT

A vacuum cleaner includes a housing having a housing passage with a passage inlet, air entering through the passage inlet flowing in a first direction and the housing passage directing air flowing therethrough in a second direction which is more than 90 degrees different from the first direction. The vacuum cleaner also includes a blower adapted to be used separately from the vacuum cleaner, the blower having a blower housing with a blower inlet, a blower outlet, and defining a blower passage between the blower inlet and the blower outlet, an impeller disposed in the blower passage to move air between the blower inlet and the blower outlet and a motor mounted to the blower housing and coupled to the impeller to move the impeller. The blower is detachably secured to the housing with the blower outlet disposed in communication with the passage inlet.

20 Claims, 8 Drawing Sheets

U.S. PATENT DOCUMENTS 5,412,837 A * 5/1995 Wörwag ..... 15/327.6
5,455,983 A * 10/1995 Crouser et al. ..... 15/353
5,528,794 A 6/1996 Tomasiak ..... 15/323
5,535,500 A 7/1996 Stephens et al. ..... 15/327.2
5,548,868 A 8/1996 Berfield et al. ..... 15/339
5,567,127 A 10/1996 Wentz ..... 417/312
5,606,769 A 3/1997 Tomasiak et al. ..... 15/327.6
5,611,107 A 3/1997 Tomasiak et al. ..... 15/327.2
6,055,700 A 5/2000 Holsten et al. ..... 15/327.2
6,158,083 A * 12/2000 Holsten ..... 15/327.6
6,192,551 B1 * 2/2001 Roth ..... 15/326

* cited by examiner

VACUUM CLEANER WITH MUFFLED DETACHABLE BLOWER EXHAUST

FIELD OF THE INVENTION

The present invention is directed to a vacuum cleaner with a detachable blower, and, in particular, a vacuum cleaner with a structure for reducing the exhaust noise from a detachable blower when the detachable blower is attached to the vacuum cleaner.

BACKGROUND OF THE INVENTION

Vacuum cleaners with detachable motor/impeller units, commonly referred to as blowers, are known in the art. When attached to a vacuum cleaner tank, the blower functions as part of the vacuum cleaner assembly. When detached from the vacuum cleaner tank, the blower may be used separately to provide a directable air column for the removal of leaves or other debris from a surface, for example.

Detachable blowers can be quite noisy, both when attached and detached from the vacuum cleaner tank. Conventionally, the problem with noise is addressed by changing the shape and configuration of the flow paths within the blower. One problem with such a strategy is that the noise reduction capabilities, performance characteristics, and size of the blower are interrelated. Striking a balance between these three concerns can present a sizeable challenge, and may result in compromised blower performance and/or increased blower size in exchange for reduced blower noise.

SUMMARY OF THE INVENTION

According to an aspect of the invention, a vacuum cleaner includes a housing having a housing passage with a passage inlet, the air entering through the passage inlet flowing in a first direction and the housing passage directing the air flowing therethrough in a second direction which is more than 90 degrees different from the first direction. The vacuum cleaner also includes a blower adapted to be used separately from the vacuum cleaner, the blower having a blower housing with a blower inlet, a blower outlet, and defining a blower passage between the blower inlet and the blower outlet, an impeller disposed in the blower passage to move air between the blower inlet and the blower outlet and a motor mounted to the blower housing and coupled to the impeller to move the impeller. The blower is detachably secured to the housing with the blower outlet disposed in communication with the passage inlet.

According to another aspect of the invention, a vacuum cleaner includes a housing having a housing passage with a passage inlet, the air entering through the passage inlet flowing in a first direction and the housing passage directing the air flowing therethrough in a second direction which is about 180 degrees different from the first direction. The vacuum cleaner also includes a blower adapted to be used separately from the vacuum cleaner, the blower having a blower housing with a blower inlet, a blower outlet, and defining a blower passage between the blower inlet and the blower outlet, an impeller disposed in the blower passage to move air between the blower inlet and the blower outlet and a motor mounted to the blower housing and coupled to the impeller to move the impeller. The blower is detachably secured to the housing with the blower outlet disposed in communication with the passage inlet.

According to a further aspect of the invention, a vacuum cleaner includes a housing having a housing passage with a passage inlet. The vacuum cleaner also includes a blower adapted to be used separately from the vacuum cleaner, the blower having a blower housing with a blower inlet, a blower outlet, and defining a blower passage between the blower inlet and the blower outlet, an impeller disposed in the blower passage to move air between the blower inlet and the blower outlet and a motor mounted to the blower housing and coupled to the impeller to move the impeller. The blower is detachably secured to the housing with the blower outlet disposed in communication with the passage inlet and air entering the passage inlet from the blower output in a first direction. The housing passage is constructed to substantially limit the movement of the air in the first direction at least in a section of the passage adjacent the passage inlet.

DETAILED DESCRIPTION OF THE EMBODIMENTS

Figure 1:
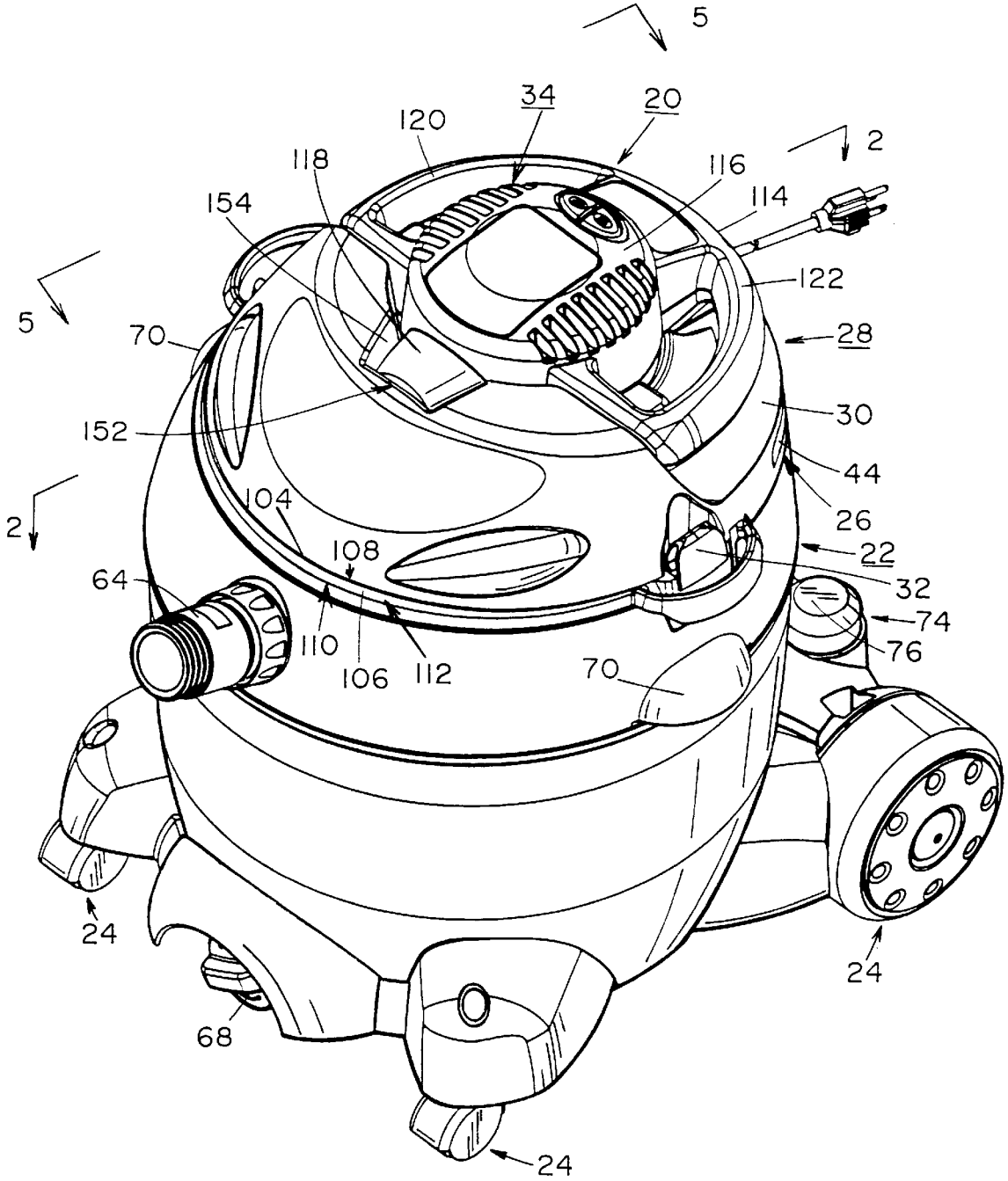
FIG. 1 is a perspective view of a vacuum cleaner according to an embodiment of the present invention.

FIG. 1 shows an embodiment of a vacuum cleaner 20 according to the present invention. The vacuum cleaner 20 is of a tank-type variety, but the embodiments of the present invention are not so limited, and may include all manner of vacuum cleaners, as will be recognized.

Figure 5:
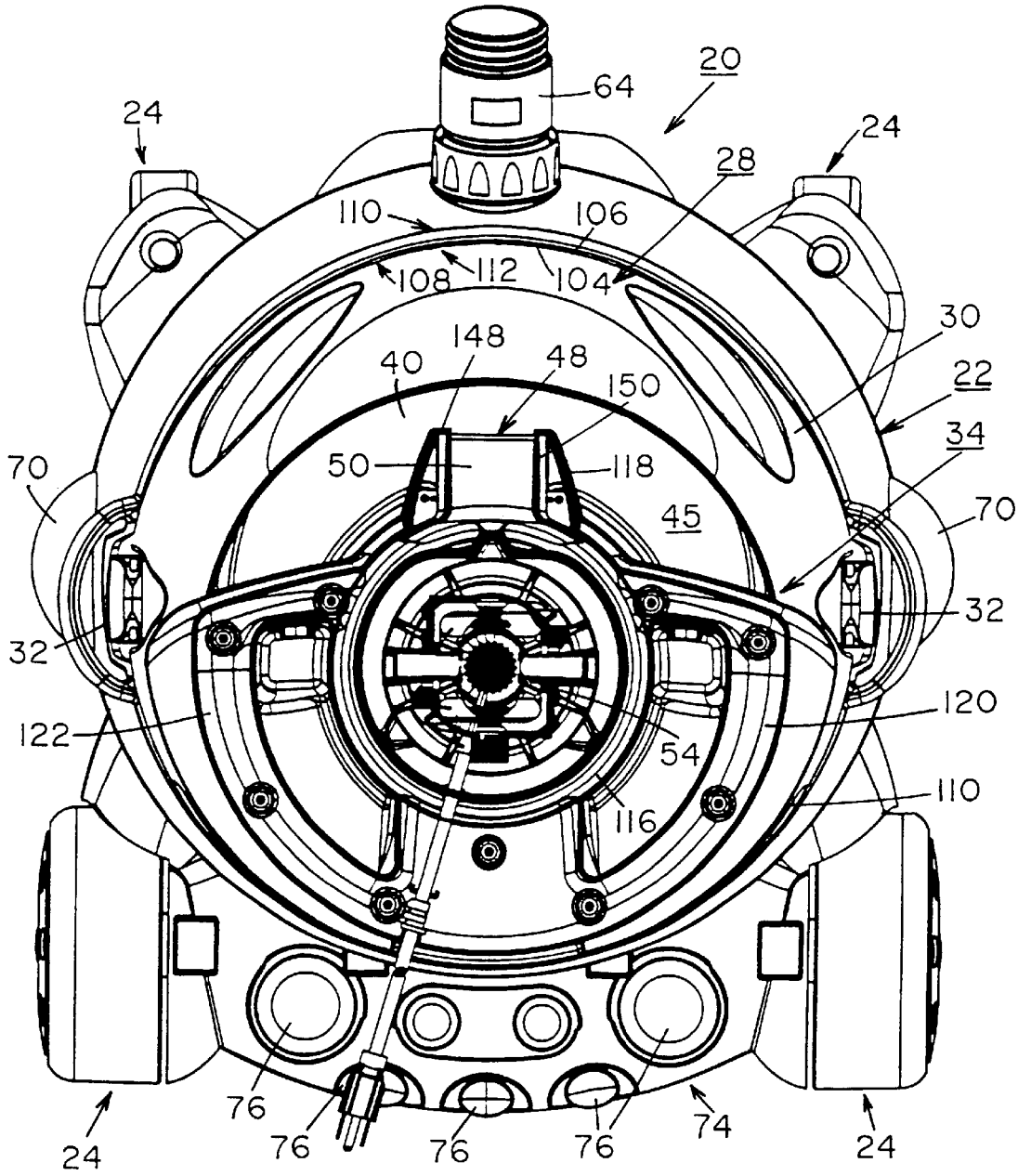
FIG. 5 is a sectional view of the vacuum cleaner of FIG. 1 taken along line 5—5.
Figure 6:
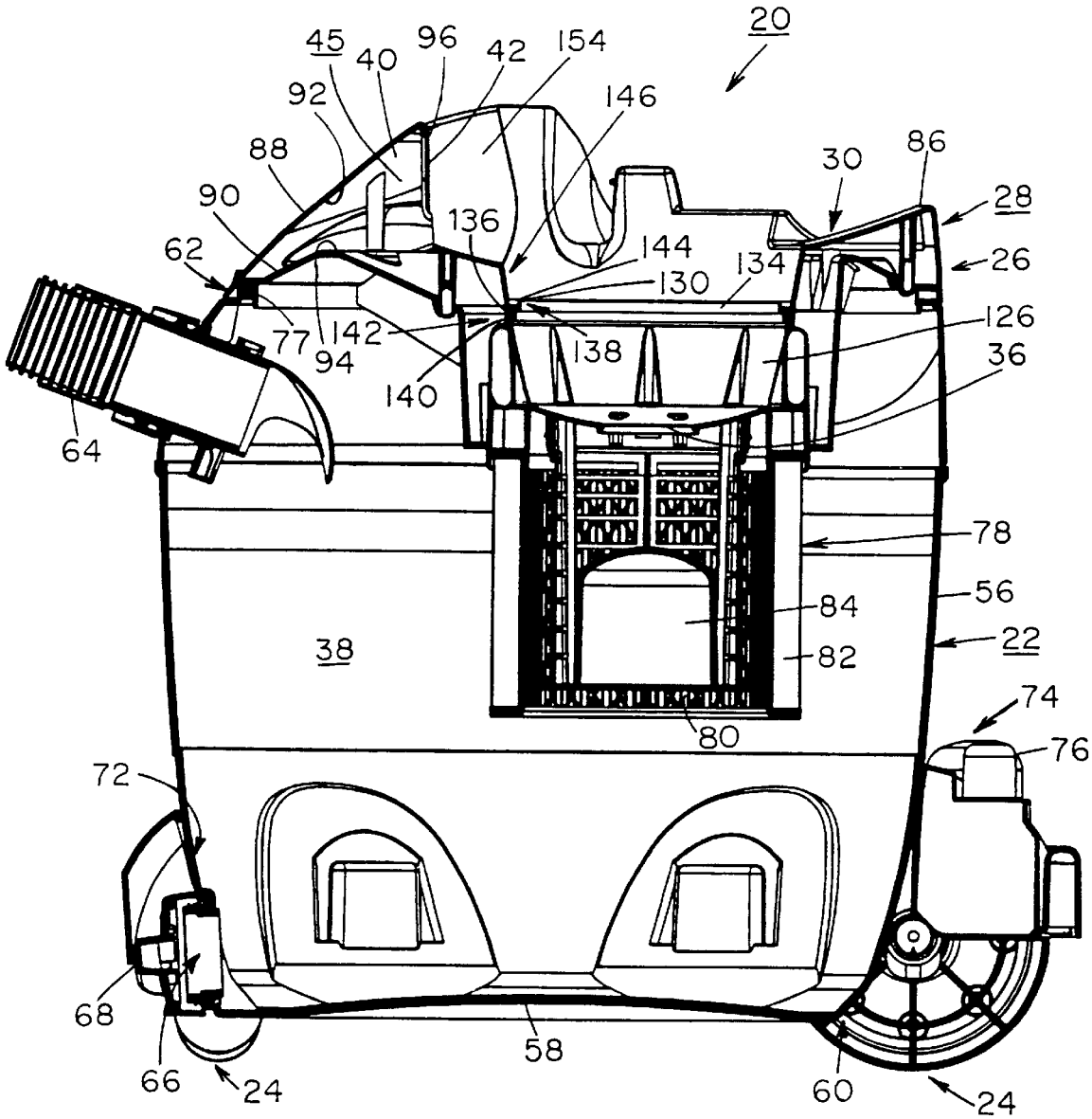
FIG. 6 is a sectional view of the vacuum cleaner of FIG. 1 taken along line 2—2 with the blower removed.
Figure 8:
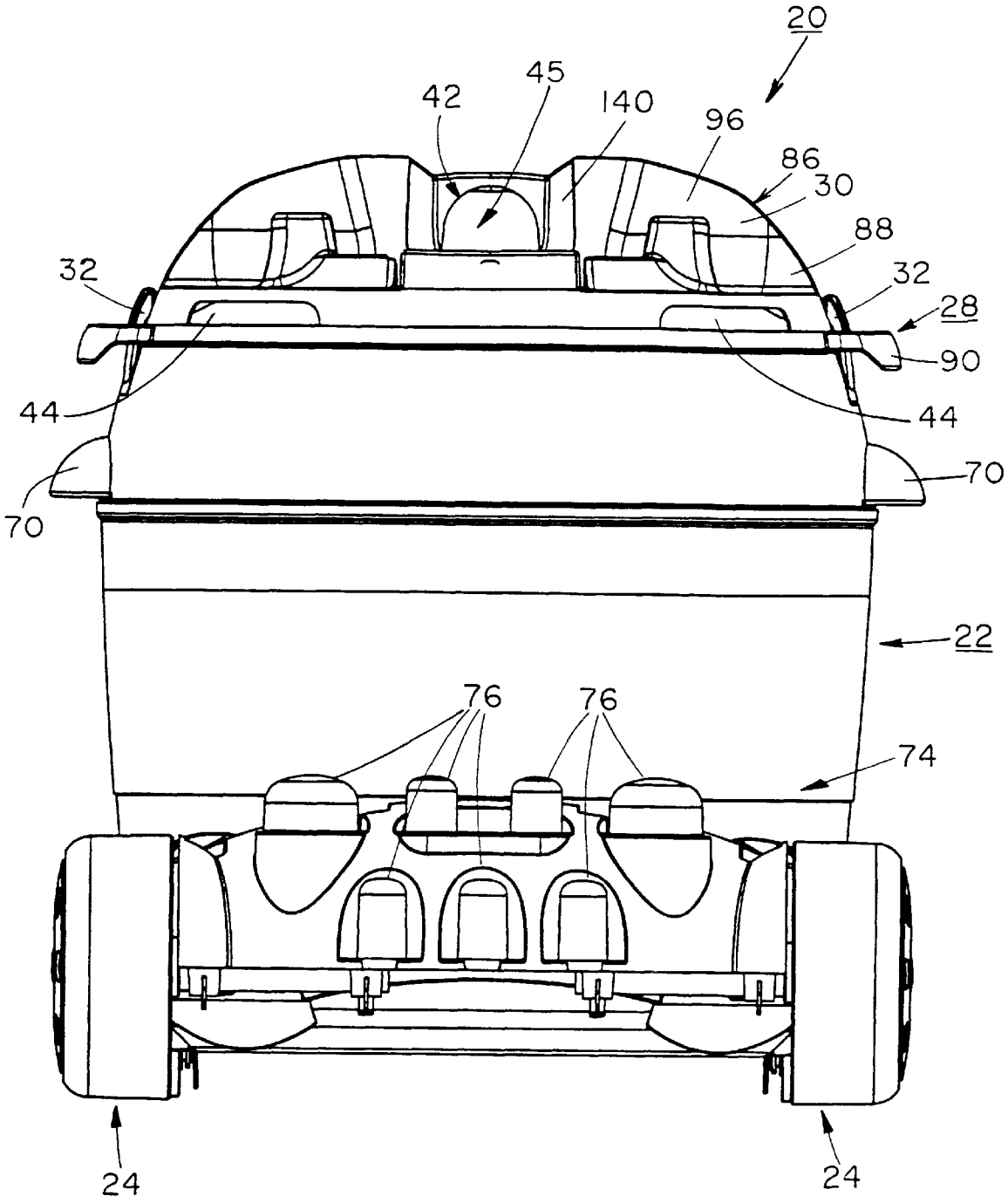
FIG. 8 is a rear view of the vacuum cleaner of FIG. 1 with the blower removed.

The vacuum cleaner 20 includes a tank 22 mounted on wheels 24. The tank 22 has an open end 26 which is covered by a lid assembly 28. The lid assembly 28 includes a lid 30 and latches 32 (one of which is shown in FIG. 1, and both of which are shown in FIGS. 5 and 8) to secure the lid 30 to the tank 22. The vacuum cleaner 20 also includes a detachable blower 34 which may be detachably secured to the lid assembly 28 by additional latches (not shown).

Figure 2:
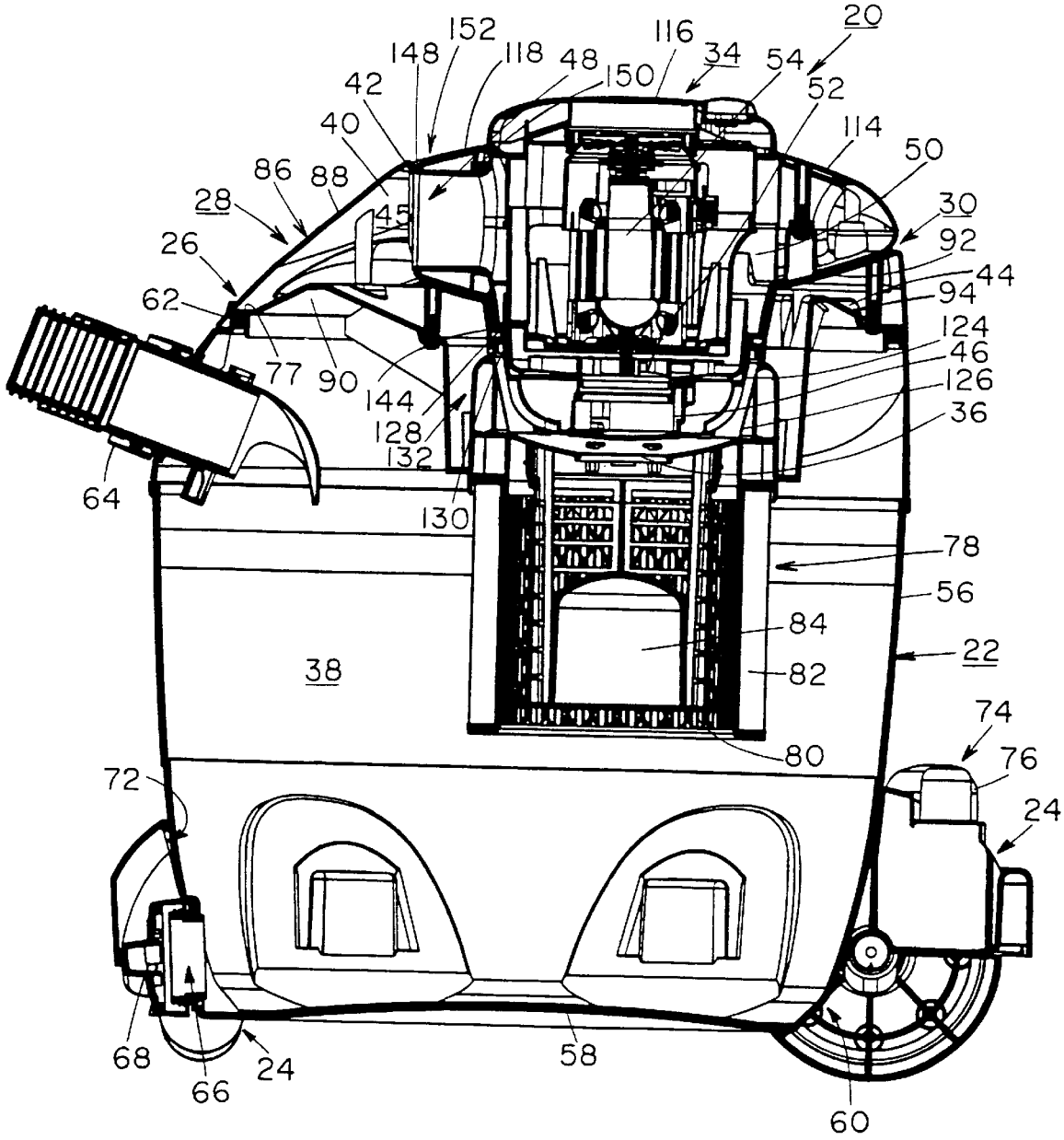
FIG. 2 is a sectional view of the vacuum cleaner of FIG. 1 taken along line 2—2.

Referring now to FIG. 2, it will be recognized that the lid 30 has an opening 36 which is in communication with the interior 38 of the tank 22. The lid 30 also includes a lid passage 40 having a lid passage inlet 42 and lid passage outlets 44 (one shown in FIG. 2, both shown in FIG. 8). The lid passage 40 is shaped such that air flowing in the lid passage 40 must change direction more than 90 degrees (preferably about 180 degrees) at least once between the lid passage inlet 42 and the lid passage outlets 44. The lid passage 40 also includes a chamber or plenum 45 into which the air entering through the lid passage inlet 42 initially enters and expands. A substantial distance is traveled by the air as it passes through the lid passage 40 between the lid passage inlet 42 and the lid passage outlets 44.

As also seen in FIG. 2, the blower 34 has a blower inlet 46, a blower outlet 48 and a passage 50 which extends between and connects the blower inlet 46 and the blower outlet 48. The blower inlet 46 is in communication with the opening 36, and the blower outlet 48 is in communication with the lid passage inlet 42. The blower 34 also includes an impeller 52 which is driven by a motor 54. The motor 54 drives the impeller 52 to draw air through the opening 36 and blower inlet 46 and to exhaust that air through the blower outlet 48 into the lid passage inlet 42.

By permitting the air exhausted from the blower outlet 48 to expand through the passage 40 and exit the vacuum cleaner 20 via the lid passage outlets 44, it is believed that a significant reduction in the noise level may be achieved. Particularly, the initial chamber 45 of the passage 40, providing for rapid expansion and redirection of the air flow, is believed to provide a reduction in noise. The length of the remainder of the passage 40 is believed to provide additional and separate reductions in noise level. Further, these reductions in noise level are achieved without modifying the design of the blower 34.

The vacuum cleaner 20 is now discussed in greater detail with reference to FIGS. 1–8.

Turning again to FIGS. 1 and 2, it will be noted that the tank 22 is generally cylindrical in nature having a side wall 56 and a bottom wall 58. The side wall 56 and the bottom wall 58 form a closed end 60, thereby enclosing the interior space 38 of the tank 22. An upper rim 62 of the side wall 56 defines the open end 26 referred to previously.

Disposed into the side wall 56 is a nozzle 64, which may be attached to all manner of vacuum cleaner implements as will readily be recognized. Also provided in the side wall 56 is a drain opening 66 which is closed by a plug 68. The drain opening 66 is provided in the tank 22 to permit the exhaust of fluid from the tank 22 when the vacuum cleaner 20 is used in its so-called "wet vac" mode. Also attached to the side wall 56 are handles 70. The handles 70 are spaced about the circumference of the side wall 56 so as to permit the tank 22 to be tipped to remove the contents thereof, particularly when the vacuum cleaner 20 is used to collect dry materials, such as sawdust, in its so-called "dry vac" mode.

As previously alluded to, the tank 22 is mounted on wheels 24. The wheels 24 are particularly useful when the tank 22 becomes filled with either liquid or dry material, which can make the vacuum cleaner 20 quite heavy and difficult to move or lift. Optionally, a tool caddy 74 with holders 76 for receiving vacuum cleaner tools or implements (not shown) is attached to the tank 22, as can be best seen in FIG. 8.

As mentioned previously, the open end 26 of the tank 22 is covered by the lid assembly 28. Particularly, as seen best in FIG. 4, the lid assembly 28 has a cup-shaped channel 77 which extends about the periphery of the lid assembly 28. The channel 77 cooperates with the rim 62 of the side wall 56 to form an air-tight seal.

Attached to the underside of the lid assembly 28, and more particularly the lid 30, is a filter assembly 78. The filter assembly 78 includes a cage 80 which surrounds the opening 36, a filter 82 disposed on the cage 80, and a float 84 disposed within the cage 80. The filter 82 removes any materials which may become entrained in the air flow drawn into the opening 36, to prevent those materials from coming in contact with the impeller 52. The float 84 is provided to cover the opening 36 if the tank 22 becomes so filled with liquid that there is a risk that the liquid would enter the opening 36 and reach the blower 34.

Also as referred to previously, the lid assembly 28 includes the lid 30 and latches 32, which detachably secure the lid 30 to the tank 22 at the open end 26 of the tank 22. The lid (or housing) 30 is itself an assembly 86 of a cover 88 and a base 90. The cover 88 and the base 90 are preferably polypropylene, but other materials may be used as will be recognized. The cover 88 includes the lid passage inlet 42 and the lid passage outlets 44, while the base 90 includes the opening 36. With the cover 88 secured to the base 90, facing surfaces 92, 94 of the cover 88 and the base 90 cooperate to define the lid passage 40.

Figure 3:
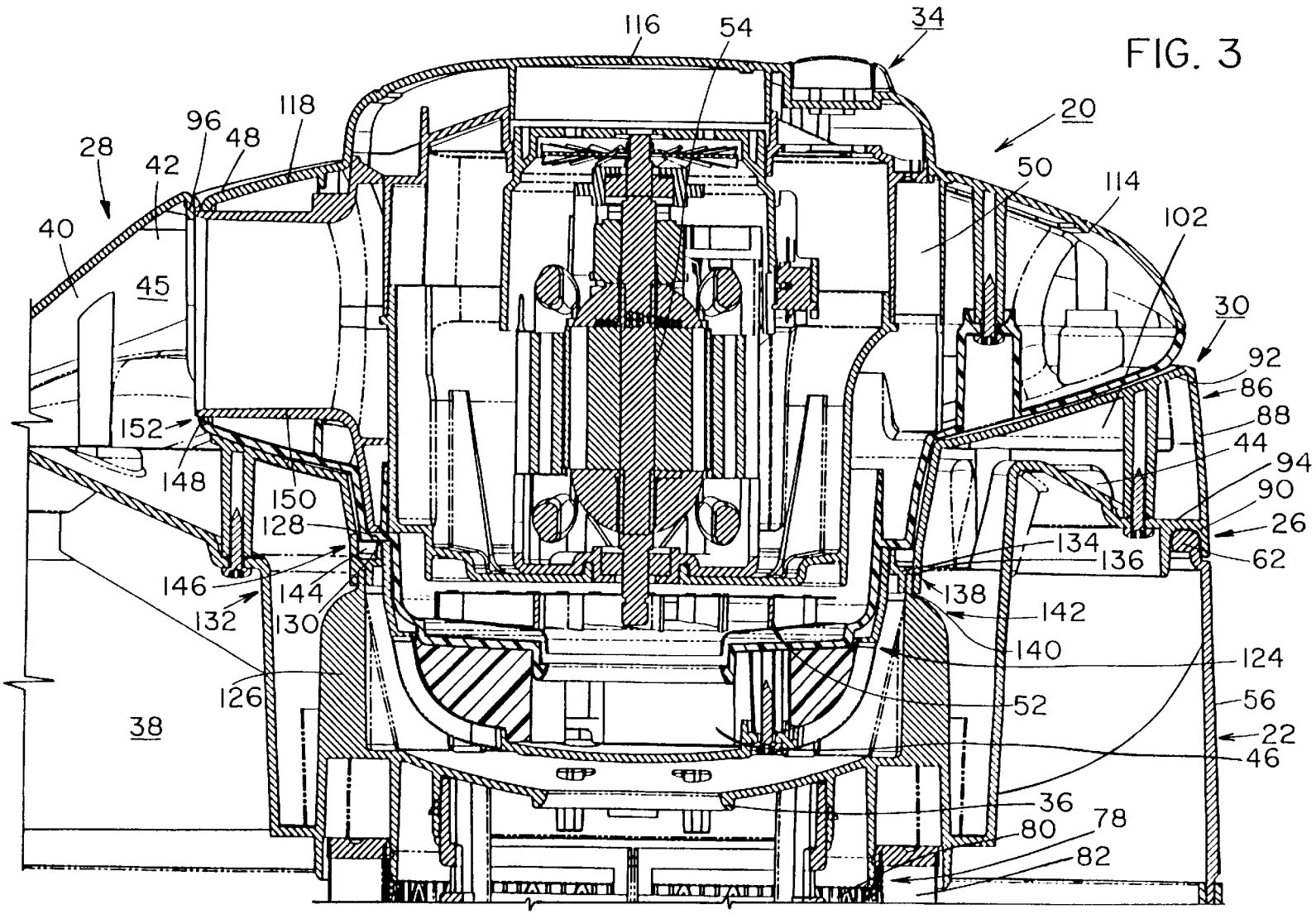
FIG. 3 is a partial sectional view of the vacuum cleaner of FIG. 1 taken along line 2—2.
Figure 7:
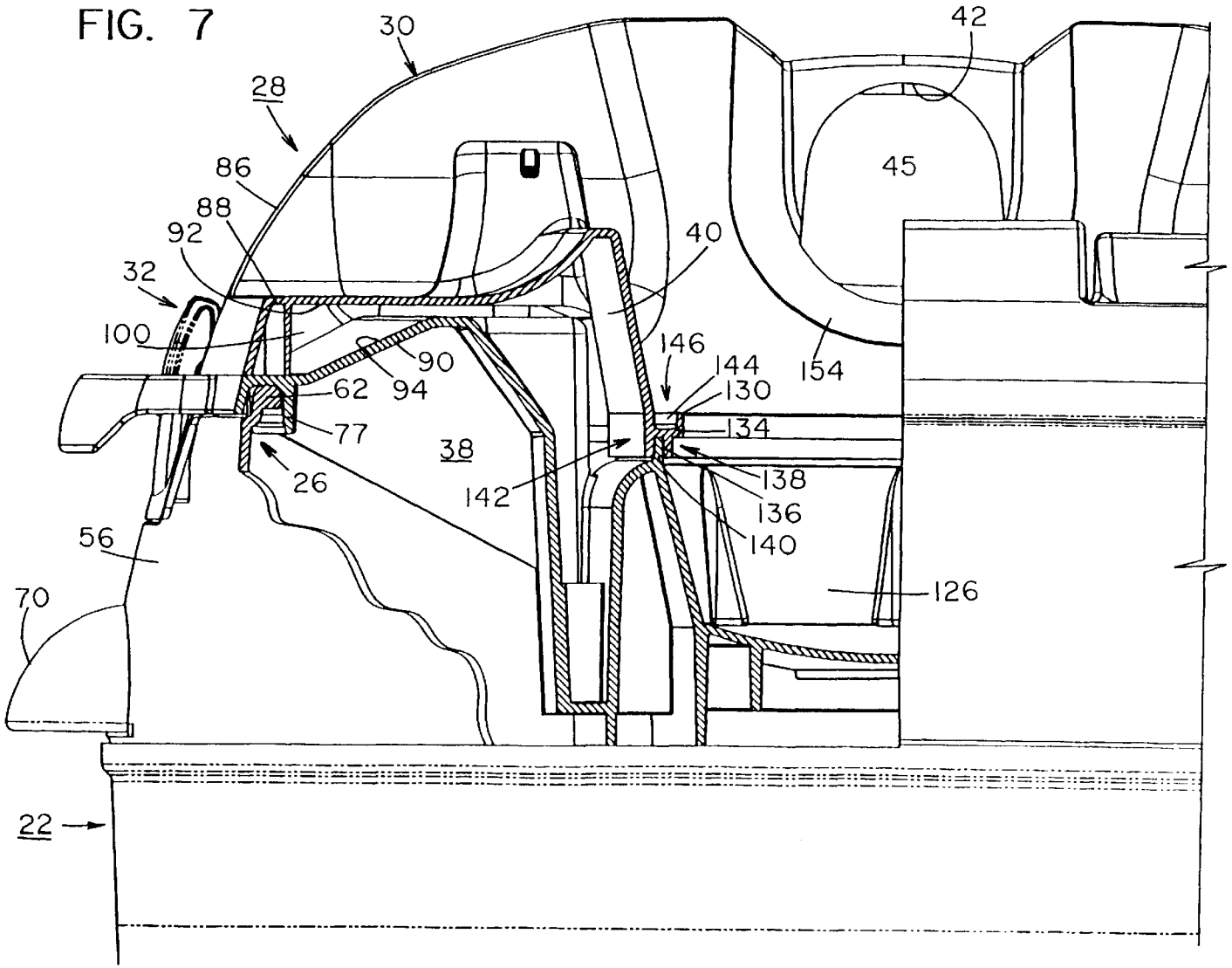
FIG. 7 is a partial sectional view of the vacuum cleaner of FIG. 1 with the blower removed.

More particularly, as seen in FIG. 3, a raised wall 96 of the cover 88 defines the chamber 45 in communication with the blower outlet 48. The facing surfaces 92, 94 subsequently cooperate, as best seen in FIG. 7, to define at least a section 100 of lid passage 40 which is disposed substantially about the circumference of the cover 88 and the base 90, which are themselves substantially circular in shape. The facing surfaces 92, 94 then define a flattened section 102 of the lid passage 40 through which the air passes before passing through the lid passage outlets 44.

Figure 4:
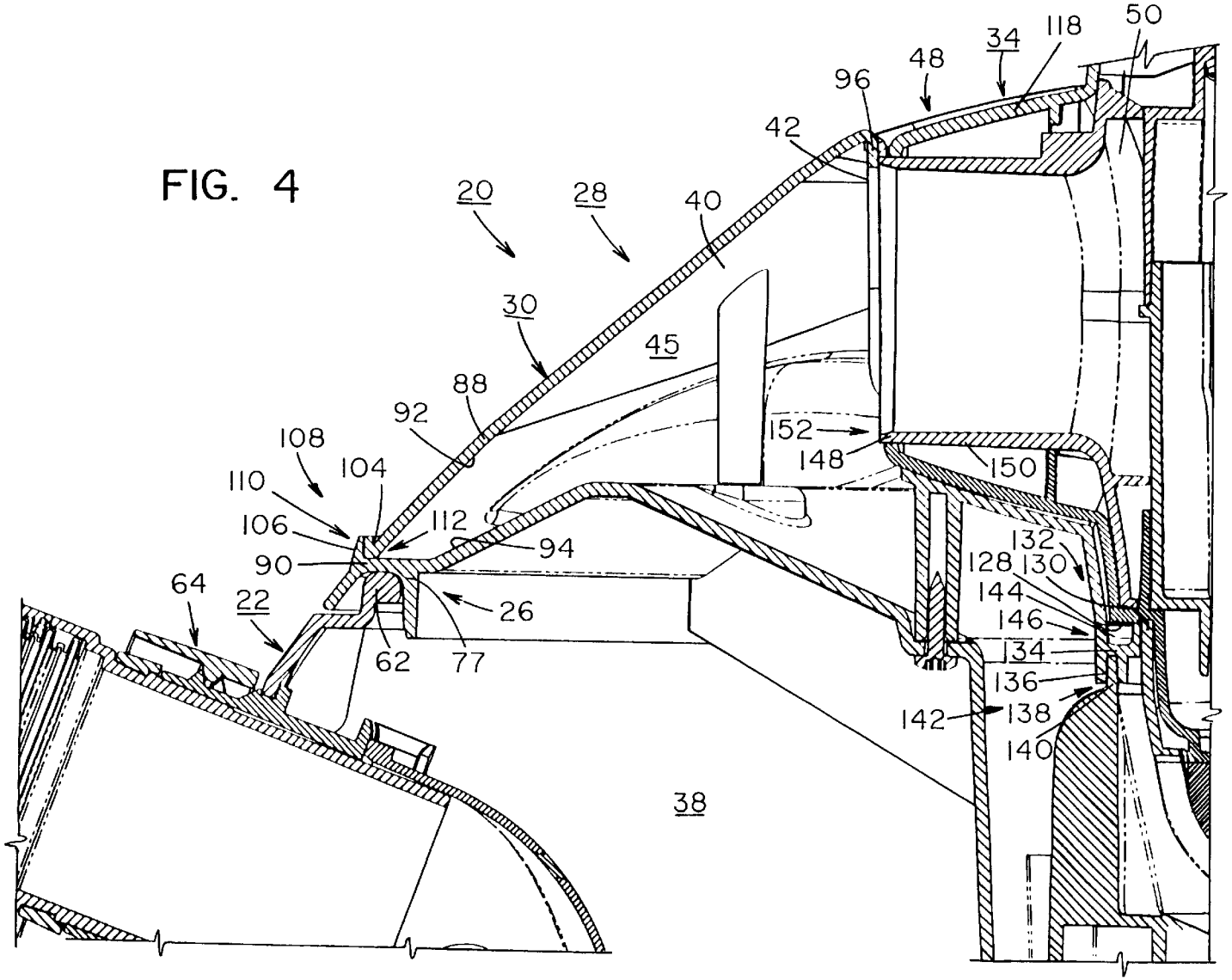
FIG. 4 is an enlarged, partial sectional view of the vacuum cleaner of FIG. 1 taken along line 2—2

As the air initially enters the chamber 45, the air applies considerable force to the cover 88 and the base 90 so as to attempt to drive the cover 88 and the base 90 apart. As best seen in FIGS. 4 and 5, to prevent the cover 88 and the base 90 from being driven apart, cooperating rims 104, 106 are formed along forward edges 108, 110 of the cover 88 and the base 90, respectively. The rim 104 is seated in the rim 106 with the cover 88 secured to the base 90, and as the air acts over the surfaces 92, 94, the rims 104, 106 react so as to provide an even firmer air-tight seal 112 along these edges 108, 110.

Returning to FIGS. 2 and 3, the blower 34 includes a housing 114 which defines the blower inlet 46, the blower outlet 48, and the blower passage 50. The housing 114 also mounts the motor 54 which is coupled to the impeller 52.

The housing 114 of the blower 34 has a central hub section 116 from which depend a nozzle 118 and handles 120, 122. The housing 114 is shaped to be symmetrical about an axis such that the handles 120, 122 may be used interchangeably by the user. As best seen in FIG. 3, the central hub 116 of the housing 114 also has a protrusion 124 which houses the impeller 52. The protrusion 124 is received in a depression 126 formed in the base 90.

The housing 114 further includes a shoulder 128 which cooperates with a mating shoulder 130 of the lid 30 to form a substantially air-tight seal 132 between the lid 30 and the blower 34. Specifically, the shoulder 130 of the lid 30 is defined by an annular wall 134 of the cover 88. The wall 134 has a first annular groove 136 in a first side 138 of the wall 134 to cooperate with a wall 140 of the base 90 to form a tongue-and-groove joint 142 between the cover 88 and the base 90. The wall 134 also may have a second annular groove 144 in a second side 146 of the wall 134. Optionally, a gasket (not shown) may be disposed in the second annular groove 144 between the shoulder 128 of the blower 34 and the shoulder 130 of the lid 30 to enhance the tightness of the seal 132 between the blower 34 and the lid 30.

The cooperation of the blower 34 (the protrusion 124) and the lid 30 (the depression 126) snugly sites the nozzle 118, or more particularly a rim 148 of a ferrule 150 disposed in the nozzle 118 which defines the blower outlet 48, against the raised wall 96 of the cover 88. The snug abutment of the rim 148 against the raised wall 96 provides a substantially air-tight seal 152 between the blower outlet 48 and the lid passage inlet 42. It will be also noted from FIG. 7 that the raised wall 96 of the cover 88 includes a U-shaped saddle 154 adjacent the lid passage inlet 42 in which the nozzle 118 of the blower 34 is disposed with the blower outlet 48 in communication with the lid passage inlet 42.

As discussed above, it is believed that by providing the chamber 45 adjacent the lid passage inlet 42 so as to permit rapid expansion and redirection of the air, the noise of the vacuum cleaner 20 may be reduced. Moreover, as noted, the rims 104, 106 of the cover 88 and base 90 cooperate to resist the tendency of the cover 88 and the base 90 to separate in the vicinity of the chamber 45 given the significant forces involved. A further reduction in noise may be achieved as the air flows through the lid passage 40, especially given the substantial distance over which the air passes between the lid passage inlet 42 and the lid passage outlets 44. Additionally, these reductions in noise maybe achieved without the necessity of modifying the blower 34, and is thus useful without concern for the design of the blower 34.

Other aspects, objects, and advantages of the present invention will be obtained from a study of the specification, drawings and appended claims.

We claim:

1. A vacuum cleaner comprising:

a housing having a housing passage with a passage inlet, air entering through the passage inlet flowing in a first direction and the housing passage directing air flowing therethrough in a second direction which is more than 90 degrees different from the first direction; and a blower adapted to be used separately from the housing, the blower having a blower housing with a blower inlet, a blower outlet, and defining a blower passage between the blower inlet and the blower outlet, an impeller disposed in the blower passage to move air between the blower inlet and the blower outlet and a motor mounted to the blower housing and coupled to the impeller to move the impeller, the blower detachably secured to the housing with the blower outlet disposed in substantially direct communication with the passage inlet.

2. The vacuum cleaner according to claim 1, wherein the housing is substantially circular in shape and at least a portion of the housing passage is defined substantially about the circumference of the housing.

3. The vacuum cleaner according to claim 1, wherein:

the housing comprises a cover and a base, the cover secured to the base to define the housing passage therebetween.

4. The vacuum cleaner according to claim 3, wherein:

the cover includes a cover sealing rim about at least a section of its circumference, the base includes a base sealing rim about at least a section of its circumference complementary to the cover sealing rim, and the cover and base sealing rims cooperate with the cover secured to the base to form a substantially air-tight seal therebetween.

5. The vacuum cleaner according to claim 3, wherein:

the cover and base are substantially circular in shape, and facing surfaces of the cover and the base cooperate to define at least a section of the housing passage which is disposed substantially about the circumference of the cover and the base with the cover secured to the base.

6. The vacuum cleaner according to claim 3, wherein:

the cover has a raised wall which depends away from the base with the cover secured to the base, the raised wall having the passage inlet therethrough, the wall defining a chamber along the housing passage adjacent the passage inlet.

7. The vacuum cleaner according to claim 6, wherein:

the blower housing having a central hub and an nozzle which depends from the central hub; and the raised wall includes a U-shaped saddle adjacent the passage inlet in which the nozzle of the blower is disposed with the blower outlet in substantially direct communication with the passage inlet.

8. The vacuum cleaner according to claim 6, wherein:

the base has a depression formed therein, the blower housing has a rim which defines the blower outlet, and the rim abuts the wall about the passage inlet to maintain the blower outlet in substantially air-tight substantially direct communication with the passage inlet with the blower at least partially seated within the depression.

9. A vacuum cleaner comprising:

a housing having a housing passage with a passage inlet, air entering through the passage inlet flowing in a first direction and the housing passage directing air flowing therethrough in a second direction which is about 180 degrees different from the first direction; and a blower adapted to be used separately from the housing, the blower having a blower housing with a blower inlet, a blower outlet, and defining a blower passage between the blower inlet and the blower outlet, an impeller disposed in the blower passage to move air between the blower inlet and the blower outlet and a motor mounted to the blower housing and coupled to the impeller to move the impeller, the blower detachably secured to the housing with the blower outlet disposed in substantially direct communication with the passage inlet.

10. The vacuum cleaner according to claim 9, wherein:

the housing is substantially circular in shape and at least a portion of the housing passage is defined substantially about the circumference of the housing.

11. The vacuum cleaner according to claim 9, wherein:

the housing comprises a cover and a base, the cover secured to the base to define the housing passage therebetween.

12. The vacuum cleaner according to claim 11, wherein:

the cover includes a cover sealing rim about at least a section of its circumference, the base includes a base sealing rim about at least a section of its circumference complementary to the cover sealing rim, and the cover and base sealing rims cooperate with the cover secured to the base to form a substantially air-tight seal therebetween.

13. The vacuum cleaner according to claim 11, wherein:

the cover and base are substantially circular in shape, and facing surfaces of the cover and the base cooperate to define at least a section of the housing passage which is disposed substantially about the circumference of the cover and the base with the cover secured to the base.

14. The vacuum cleaner according to claim 11, wherein:

the cover has a raised wall which depends away from the base with the cover secured to the base, the raised wall having the passage inlet therethrough, the wall defining a chamber along the housing passage adjacent the passage inlet.

15. A vacuum cleaner comprising:

a housing having a housing passage with a passage inlet, air entering through the passage inlet flowing in a first direction and the housing passage directing air flowing therethrough in a second direction which is about 180 degrees different from the first direction;

a tank having a wall defining an interior space, an open end, and a closed end, the housing having an opening therethrough and detachably secured to the tank at the open end with the opening in communication with the interior space of the tank; and a blower adapted to be used separately from the housing, the blower having a blower housing with a blower inlet, a blower outlet, and defining a blower passage between the blower inlet and the blower outlet, an impeller disposed in the blower passage to move air between the blower inlet and the blower outlet and a motor mounted to the blower housing and coupled to the impeller to move the impeller, the blower detachably secured to the housing with the blower inlet disposed in communication with the opening and with the blower outlet disposed in communication with the passage inlet.

16. A vacuum cleaner comprising:

a housing having a housing passage with a passage inlet; and a blower adapted to be used separately from the housing, the blower having a blower housing with a blower inlet, a blower outlet, and defining a blower passage between the blower inlet and the blower outlet, an impeller disposed in the blower passage to move air between the blower inlet and the blower outlet and a motor mounted to the blower housing and coupled to the impeller to move the impeller, the blower detachably secured to the housing with the blower outlet disposed in communication with the passage inlet such that air entering the passage inlet from the blower outlet moves in a first direction, the housing passage constructed to substantially limit the movement of the air in the first direction at least in a section of the passage adjacent the passage inlet.

17. The vacuum cleaner according to claim 16, wherein:

the housing comprises a cover and a base, the cover secured to the base to define the housing passage therebetween.

18. The vacuum cleaner according to claim 17, wherein:

the cover includes a cover sealing rim about at least a section of its circumference, the base includes a base sealing rim about at least a section of its circumference complementary to the cover sealing rim, and the cover and base sealing rims cooperate with the cover secured to the base to form a substantially air-tight seal therebetween.

19. The vacuum cleaner according to claim 16, wherein:

the housing passage directs the air flowing therethrough in a second direction which is about 180 degrees different from the first direction.

20. The vacuum cleaner according to claim 16, wherein:

the housing is substantially circular in shape and at least a portion of the housing passage is defined substantially about the circumference of the housing.

* * * * *